US007156250B2

(12) United States Patent
Tillmann et al.

(10) Patent No.: US 7,156,250 B2
(45) Date of Patent: Jan. 2, 2007

(54) COLLAPSIBLE TUB-SHAPED CONTAINER

(76) Inventors: Marc Tillmann, Droysenstrasse 10, D-10629 Berlin (DE); Wolfgang Wertenbruch, Fritschestrasse 75, D-10585 Berlin (DE)

( * ) Notice: Subject to any disclaimer, the term of this patent is extended or adjusted under 35 U.S.C. 154(b) by 421 days.

(21) Appl. No.: 10/653,627

(22) Filed: Sep. 2, 2003

(65) Prior Publication Data

US 2004/0112908 A1 Jun. 17, 2004

(30) Foreign Application Priority Data

Sep. 2, 2002 (DE) ..... 202 13 664 U

(51) Int. Cl.
*B65D 30/10* (2006.01)
*B65D 33/02* (2006.01)
*A45C 7/00* (2006.01)

(52) U.S. Cl. ..... 220/9.2; 383/104

(58) Field of Classification Search ..... 220/9.1, 220/9.2, 9.4; 383/104, 109, 119
See application file for complete search history.

(56) References Cited

U.S. PATENT DOCUMENTS 5,624,157 A * 4/1997 Kostuk ..... 297/228.13
5,800,067 A * 9/1998 Easter ..... 383/104
5,967,357 A * 10/1999 Kellogg et al. ..... 220/9.2
6,112,930 A * 9/2000 McAtarian ..... 220/9.1
6,672,323 B1 * 1/2004 Gupta et al. ..... 135/126

FOREIGN PATENT DOCUMENTS

DE 197 48 902 5/1999
DE 197 25 958 7/1999

* cited by examiner

*Primary Examiner*—Nathan J. Newhouse
*Assistant Examiner*—Harry Grosso
(74) *Attorney, Agent, or Firm*—Collard & Roe, P.C.

(57) ABSTRACT

A collapsible, tub-shaped container for placing on a support, comprising a base of flexible flat material with a frame construction and side walls of flexible flat material. There are connecting walls of flexible flat material arranged between the two adjacent side walls, which have a frame construction.

17 Claims, 3 Drawing Sheets

COLLAPSIBLE TUB-SHAPED CONTAINER

BACKGROUND OF THE INVENTION

1. Field of the Invention

The invention relates to a collapsible, tub-shaped container for placing on a support, comprising a base of flexible flat material with a frame construction and side walls of flexible flat material. There are connecting walls of flexible flat material arranged between the two adjacent side walls, which have a frame construction.

2. The Prior Art

Containers of this kind known in the most diverse embodiments for use as a convertible foot muff or as a carrier container for small children, dolls, etc. Such containers can obviously also be used for storage of articles.

A foot muff that is convertible into a baby carrying pocket is known from German Patent No. DE 197 25 958 C2. This consists of a base with a base plate for reinforcing, having side reinforcing elements which are disposed thereat and are inserted from below into the side walls, made of padded flat material, of a body similar to a foot muff and which stabilise the structure.

A portable container for small children, comprising a base section and a wall, which goes out from an edge region of the base section and surrounds a lying-down region, with a pair of mutually opposite flexible longitudinal side wall sections, and a carrying device with a pair of carrying handles is known from German Patent No. DE 197 48 902 A1. In order to develop this portable container in such a manner that it can be produced simply and economically and offers a high degree of carry comfort and protection for a small child to be transported therein, angle stiffening devices for angularly-fixed connection of at least one longitudinal side section-are indicated. These are frame elements which shape the container and stabilise the side walls.

In the case of the known containers in which the side walls, the transverse connecting part and the base part can be collapsed, the stiffening base and all other frame-shaped elements which form the container always have to be removed for that purpose and separately stored. It is apparent that such a container in the case of non-use, for example as an emergency bed, needs much storage space. As travel beds they would take up a greater amount of space when stowed in a suitcase.

SUMMARY OF THE INVENTION

It is therefore an object of the invention to construct a container wherein in the case of non-use it is collapsible to the smallest space as a flat unit, without parts of the frame construction having to be removed for that purpose.

The container according to the first embodiment is distinguished from that of the second embodiment in that the first embodiment, when brought into the smallest unit after laying of the side walls over onto the base is deformed by diagonal twisting into a horizontal eight, whereby two elliptical stackable flat elements are formed, which can then in turn be folded through 180° onto one another and thus form a relatively flat unit, which is insertable into a bag in order to be stored in, for example, a cupboard or suitcase.

The solution according to the second embodiment proposes that, with use of a frame construction, segments can be folded together in a stack-shaped manner about fold edges extending transversely to the longitudinal axis of the container so that a small stowable unit is also thereby achievable. Through use of the spring elements in the frame members, it is always ensured that in the erected state the flexible flat materials are tightened and the desired tub-shaped appearance thereby produced, so that such a container can be used for, for example, babies for sleeping. In all designs, the removal of the spring elements supporting the frame construction or, however, also the rigid elements, insofar as these may not be needed for the function and may be rigidly constructed, is not necessary. They are a component of the base, the side walls and the transverse connecting elements at the head and foot part of the container, not only in the use function, but also in the collapsed state. Nevertheless, such a container can be collapsed in such a manner that it forms a stackable unit and can be stored and/or transported as a flat object without a large space requirement.

It has proved particularly advantageous to make the entire frame construction of spring steel, for example of resilient stainless steel of about 2 mm diameter, wherein the individual frame constructions are designed to be annular, regardless of whether these are now oval or round or have a substantially polygonal plan profile. It is always ensured by this construction that a certain degree of tension in the erected state is exerted on the wall material, namely the flexible flat material, which can be a textile unpadded or padded material. The base wall, the side walls and connecting walls are also automatically shaped by the spring force, for which purpose the fields of the round elements are covered by the material or introduced into pocket-shaped receptacles.

It will be obvious that such a container cannot be used as a carry pocket or carry container for small children and dolls without the stiffening elements or angle stiffening elements described above. It can, however, be connected in the simplest manner with such elements or inserted therein and can then be additionally used in the same way as a carry pocket for dolls or small children.

The frame construction envisages different courses of the spring steel in the side walls and/or in the base. In the simplest design, these are oval parts formed from spring steel and extending in the hemmed edges in the side walls and in the base, as well as an oval, annular closure frame of spring steel which fixes the upper edge and is fixedly or pivotably fastened to the upper sides of the side wall frame members and which produces an oval or elliptical shape of the upper opening. The side parts are in every case pivotably fastened to the base frame, but preferably not so as to be easily able to be folded over. This can be managed, for example, by plugged-on connecting bushes which are, for fixing, easily pressed onto one of the round, parallelly extending spring rods or onto both.

If material is to be saved, it is sufficient if the curved elements, which are provided at the upper side at the head and foot part, of the connecting walls are fastened as such only in shaped manner to the upper longitudinal spring rods of the side wall frame members.

It has proved that these connecting walls together with their curved elements permit folding together of the side walls onto the base, in fact assisted by the spring action of the curved elements and keep the side parts in the unfolded state at a spacing and form the insertion opening. In the collapsed state it is possible to twist the oval structure diagonally so that an elongated eight forms from two elliptical flat bodies. These can then be folded together again over the crossing points or plane. The spring material, which is used as frame portion, permits this. There thus arises a folded-together unit of smallest size which can be placed in simple manner in a bag or a box and can be stored or transported as a flat element.

Instead of the oval frame, however, two or more segments together with frame elements can also be joined to form a base or side members. If only two elements are used for that purpose and these are arranged at a spacing from one another then these can be connected together by longitudinal spring rods which extend at the top and at the underside and which enable the same procedure of folding together as previously described. A connection by way of a cross is also possible without the side walls significantly losing stability, since the spring action of the resilient portions or of the entire resilient frame exerts tension on the flat material. In the crossed application, thus when the frame elements already form a horizontal eight, the structure can then be similarly collapsed in simple manner and, in particular, about a fold edge extending transversely to the longitudinal axis.

If the segments are designed so that they can be folded together only in folding procedure and, in particular, transversely to the longitudinal axis of the container, then a folding together of the container is also possible by way of this.

A container according to the invention is particularly suitable as a travel bed or as an emergency bed for infants. In order to be able to fasten the container to a bed or to a changing table or to a table, fasteners may be attached to the base. These fasteners may be in the form of laterally protruding eyes, through which a carrier strap can be drawn in order to be able to fasten the base to a mattress of a bed. The carrier strap is then taken around the mattress and tied at its ends or, if a tightening device is provided at the ends, tightened by way of the tightening device. The same can also be used when setting up on a table or on another article. Moreover, it is also possible to mount flat slide fastener elements at the underside of the flat material of the base, which can, for example, hook in a self-adhering manner to the fitted cover of a mattress of a bed and be detached again. Numerous variations would be apparent to the expert in order to be able to give effect to the fastening by fastening means.

BRIEF DESCRIPTION OF THE DRAWINGS

Other objects and features of the present invention will become apparent from the following detailed description considered in connection with the accompanying drawings. It is to be understood, however, that the drawings are designed as an illustration only and not as a definition of the limits of the invention.

Basic design possibilities of the frame construction and container construction are schematically indicated in the drawings, in which.

DETAILED DESCRIPTION OF THE PREFERRED EMBODIMENT

Figure 1:
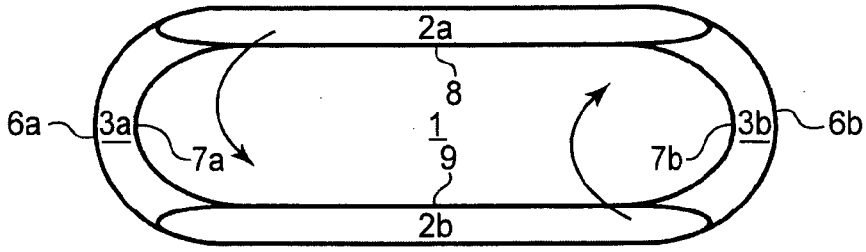
FIG. 1 shows a top plan view of a first embodiment of the invention.

Referring now in detail to the drawings, FIG. 1 shows a container according to the invention in a schematic plan view. This consists of an oval, elongate base 1, erected side walls 2*a* and 2*b* which are of the same profile and which are illustrated in distorted form by the plan view, and connecting walls 3*a* and 3*b* which form the head part and foot part of the container and connect the ends of the side walls 2*a* and 2*b* by joining therebetween. The container according to FIG. 1 is stabilized by a frame construction, over which is inserted, or which is inserted into, a tub-shaped, sewn textile body which is sewn in such a manner that the wall elements, which are predetermined, are shaped by the frame construction. In other words, a tub-shaped structure is sewn from a textile material which advantageously is formed to be hollow overall and has at the underside of base 1 a lengthwise slide fastener or a hook-and-burr fastener in order to introduce the spring wire frame construction via this opening. In addition, the frame construction need only consist of the resilient material in portions. It can also be composed of rigid elements and/or of resilient rod-shaped elements. The resilient elements in that case are to be fitted in such a manner that the collapsing procedure is thereby ensured and beyond that in the erected state, a desired spreading of the base and a spreading of the side walls are also given, as well as a fixing of the connecting walls.

Fold axes 8 and 9 are provided between side walls 2*a* and 2*b* and the base. These mean that the two side walls can be folded in succession, in correspondence with the illustrated arrow directions, onto the base. Fold axes 8 and 9 are formed by a stiff connection that acts as a hinge between the frame elements 4 of base 1 and the side walls 2*a*, 2*b*.

Figure 2:
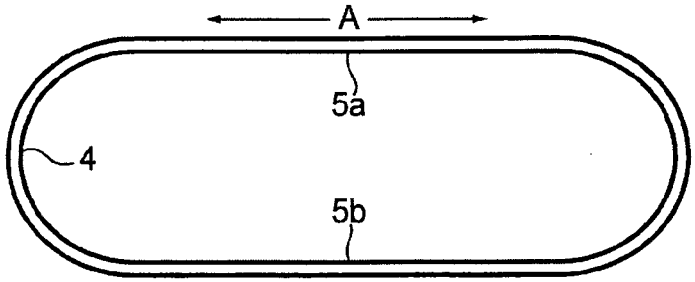
FIG. 2 shows the invention in a folded-together form.

The folded-together form is schematically illustrated in FIG. 2. Also apparent from FIG. 2 are the portions A which are stackable spring members 5*a* and 5*b* which enable a further collapsing and folding. It is additionally evident from FIG. 2 that base 1 and side walls 2*a* and 2*b* have the same contours or the side walls are slightly smaller in order to be able to be folded into the base. The connections between the frame in the side walls and the frame in the base have to be constructed in such a manner that pivot movement possible and account is also taken of the stacking arrangement. The curved elements 6*a* and 6*b*, which connect the upper sides of side walls 2*a* and 2*b* together and are similarly incorporated in the textile structure, wherein the connecting walls 3*a* and 3*b* are formed automatically, consist of resilient material, particularly spring steel. Elements 6*a* and 6*b* are so designed that when one side wall 2*a* is folded onto base 1 and when second side wall 2*b* is subsequently folded over onto first side wall 2*a*, an automatic collapsing of side walls 3*a* and 3*b* takes place. The curved elements 6*a*, 6*b* automatically re-erect when unfolded and assist the folding process in the desired manner.

Figure 10:
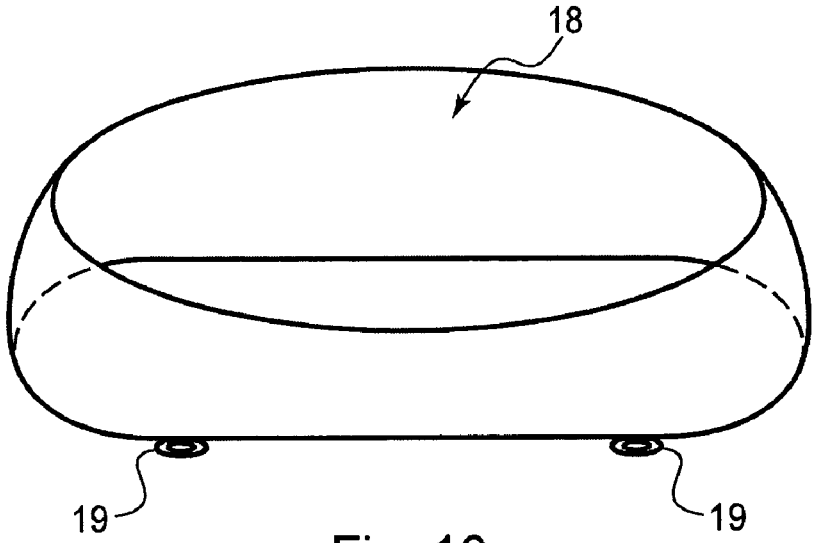
FIG. 10 shows a perspective view of the embodiment of FIGS. 1 and 2.
Figure 11:
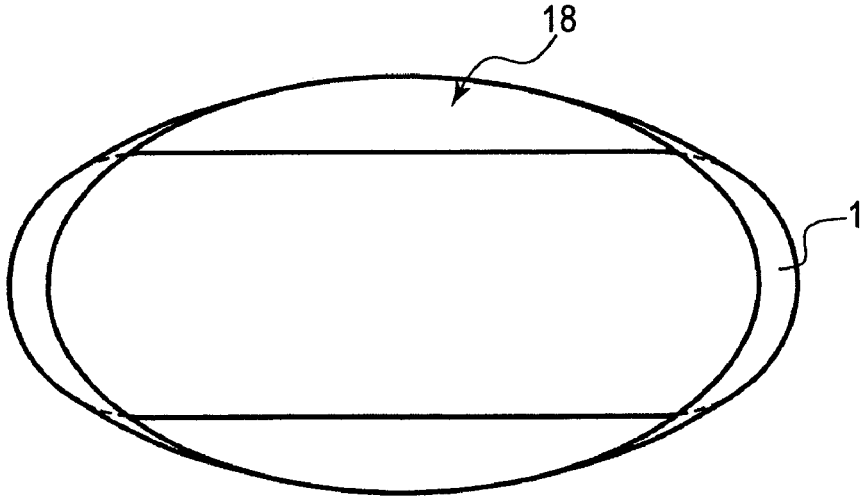
FIG. 11 shows a top view of the embodiment of FIGS. 1 and 2.

In order to achieve this, the curved elements 6*a* and 6*b* are constructed with a larger radius than the curved transverse connecting portions 7*a* and 7*b* of the base. In the erected state of the container, these elements produce an elliptical shape of the upper opening 18 with a longitudinal width which is shorter than the base length dimension, which is apparent from the photographically perspective illustration in FIG. 10 and the plan view, which is precise in terms of shape, in FIG. 11. FIG. 10 additionally shows laterally protruding eyes 19 which are, for example, sewn on and fix the container to a support.

Figure 3:
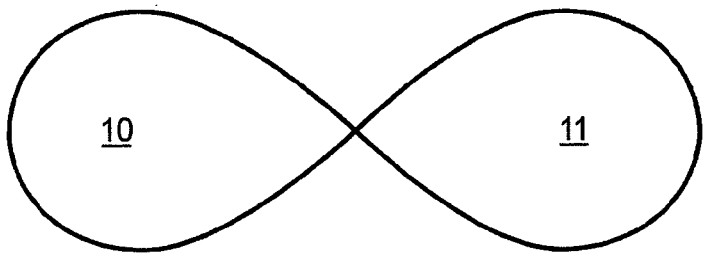
FIG. 3 shows the invention in a deformed state forming two ellipses.
Figure 4:
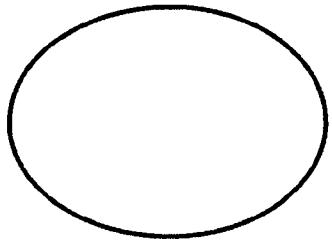
FIG. 4 shows the invention of FIG. 3 with the two ellipses folded together.

With frames of different dimensions, the folding is not as advantageous. If the two side walls 2*a* and 2*b* are folded onto base 1 as apparent from FIG. 2, then this oval elongate structure according to FIG. 3 can be deformed by diagonal twisting into an elongate eight so that two elliptical areas or drop-shaped parts interconnected by way of the portions 5*a* and 5*b* according to FIG. 2 arise, which can be folded together as apparent from FIG. 4, namely by way of the connection cross. When using spring steel, this is possible in the simplest manner without functional disadvantages. It has proved particularly advantageous to use stainless steel as spring steel with a diameter of approximately 2 mm to approximately 3.5 mm.

Figure 5:
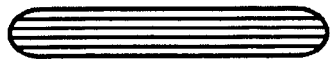
FIG. 5 shows a side view of the invention in a folded position.

The stack is schematically illustrated in side view in FIG. 5. Such a collapsed stack consisting of the segments formed by the folding together can now in simplest manner be placed in a bag and stored therein.

Figure 6:
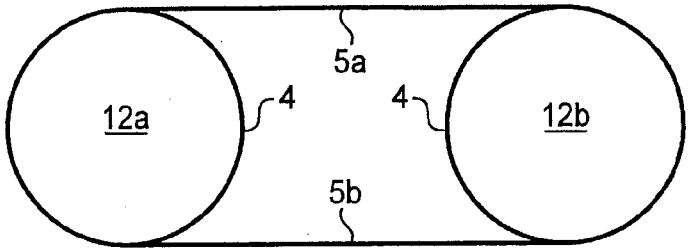
FIG. 6 shows an alternative embodiment of the invention.

FIG. 6 shows a variant with respect to the formation of the frame construction in the base and/or the side walls. Here, there are two annular frames, which can consist of rigid material or also of resilient material and form the segments 12*a* and 12*b*. These are connected together for formation of the oval by way of spring rod members 5*a* and 5*b*. These frames are coupled with those of the base and the side walls just as described by reference to the embodiments according to FIGS. 1 to 5. Base and side walls can thus be constructed in this manner, but it is also possible to construct the base according to FIG. 1 as an oval and the side walls in the indicated manner according to FIG. 6, whereby a reinforcement of the side walls is given by the annular form of the segments 12*a* and 12*b* and by the frame elements 4. The collapsing of this structure is possible in the same manner as described by reference to FIGS. 1 to 5.

Figure 7:
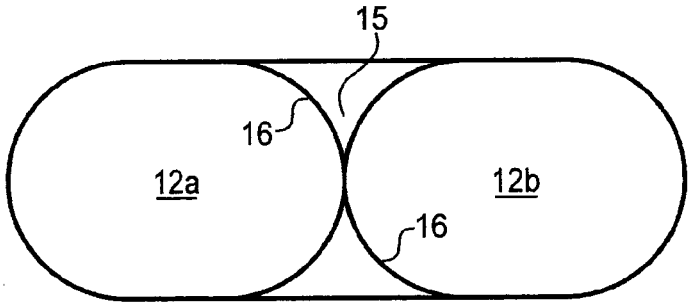
FIG. 7 shows another alternative embodiment of the invention.

In FIG. 7 there is illustrated a variant in which the two oval segments 12*a* and 12*b* are connected together by way of the internally disposed frame elements 16. It is also apparent therefrom that this arrangement also makes it possible to fold the container together once more about the indicated fold axis 15 in the collapsed state of the base and the side walls.

Figure 8:
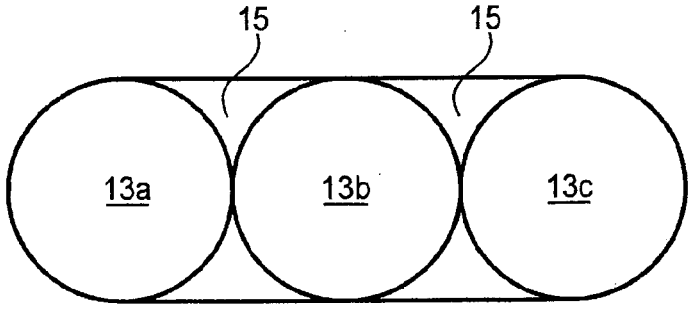
FIG. 8 shows yet another alternative embodiment of the invention.

FIG. 8 shows a three-segment arrangement. This, too, is foldable once more by way of the indicated fold axes 15 in desired manner after collapsing of the side parts and the base. In this embodiment, the segments are round. It is obvious that in the case of the embodiments according to FIGS. 7 and 8, the connecting walls 3*a* and 3*b*, which are not illustrated, have to be detachably coupled at the top to the side walls in order to be able to be incorporated in the folding. With these embodiments it is also not necessary for the frame elements of the connecting elements to be resilient. They can also be constructed to be rigid. This also equally applies to the frame elements 16 as used in the segments 12*a, b*; 13*a, b, c*.

Figure 9:
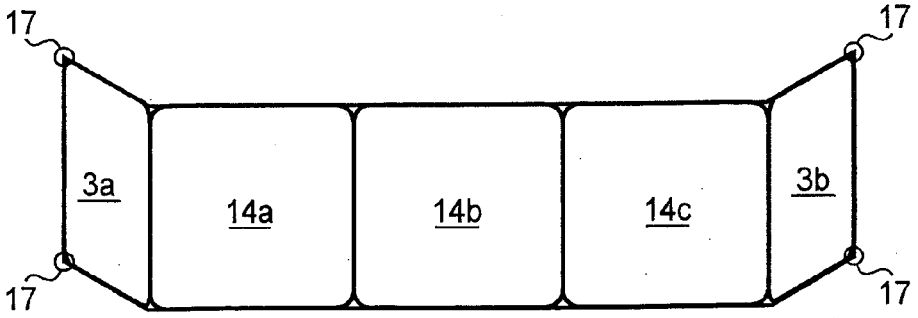
FIG. 9 shows yet another alternative embodiment of the invention.

FIG. 9 shows a variant with respect to FIGS. 7 and 8, consisting of substantially polygonal segments 14*a*, 14*b*, 14*c*, which can be folded onto one another by way of transversely extending fold axes 15. The side walls, which are similarly formed to be identical, are not illustrated here. The connecting walls 3*a* and 3*b* are fastened at their upper corners by way of press studs 17. After release of the press studs the connecting walls 3*a* and 3*b* can be laid onto the folded-up side walls and then, after the collapsing, the parts 14 are folded on 14*b* and 14*a* on the part 14*c* about the fold edges 15 so that a unit of smallest size similarly results.

Accordingly, while only a few embodiments of the present invention have been shown and described, it is obvious that many changes and modifications may be made thereunto without departing from the spirit and scope of the invention.

REFERENCE NUMERAL LIST

1 base
2*a* side wall
2*b* side wall
3*a* connecting wall
3*b* connecting wall
4 frame element
5*a* spring rod member
5*b* spring rod member
6*a* curved element
6*b* curved element
7*a* transverse connecting portion
7*b* transverse connecting portion
8 fold axis
9 fold axis
10 stack half
11 stack half
12*a* segment
12*b* segment
13*a* segment
13*b* segment
13*c* segment
14*a* segment
14*b* segment
14*c* segment
15 fold edge
16 frame element
17 press stud
18 elliptical opening
19 eyes

What is claimed is:

1. A collapsible, tub-shaped container for erection on a support, comprising:

a base (1) of flexible flat material with a frame construction, side walls (2*a*, 2*b*) of flexible flat material and having a frame construction, wherein outer contours of the side walls (2*a*, 2*b*) are constructed to be substantially congruent with or smaller or larger than outer contours of the base (1) and to be foldable into or onto the base (1);

connecting walls (3*a*, 3*b*) between the side walls (2*a*, 2*b*);

frame elements (4) disposed in the side walls (2*a*, 2*b*) and the base, said frame elements, at least in a center longitudinal portion (A), comprising flexible spring rod members (5*a*, 5*b*) which are arranged to extend or intersect in outer edges to form in common with other portions of the frame elements (4) a figure-eight-shaped course, a curved element connecting the side walls (2*a*, 2*b*) together at an upper side at each of the front and the back;

wherein a first side wall (2*a*) of the two side walls (2*a*, 2*b*) can be folded over or pivoted onto the base (1) at an outer side thereof about a pivot axis or fold axis (8) extending longitudinally in an edge region, wherein with simultaneous drawing in and turning in of the curved elements (6*a*, 6*b*) of the respective connecting walls (3*a*, 3*b*), the second side wall (2*b*) can be folded onto the first, folded-over side wall at the outer side of the base (1) about a fold axis (9) extending longitudinally in an edge region and wherein by diagonal twisting and subsequent folding together of a thus-formed one stack half (10) onto another stack half, said stack halves are collapsible in a substantially congruent manner.

2. A container according to claim 1, wherein the frame elements consist of round, polygonal or profiled spring wire or resilient synthetic material.

3. A container according to claim 2, wherein the spring wire is spring steel and has a diameter of approximately 1 mm to approximately 3.5 mm.

4. A container according to claim 1, wherein the contour of the base (1) and the contour of the side walls (2*a*, 2*b*) are oval.

5. A container according to claim 4, wherein the base (1) has a length of approximately 100 cm and curved transverse connecting portions (7*a*, 7*b*) and is approximately 35 cm wide, wherein the side walls have the same or slightly differing dimensions and wherein the curved elements (6*a*, 6*b*) are dimensioned in such a manner that an overall length of an upper elliptical opening (18) when the side walls (2*a*, 2*b*) are erected is approximately 90 cm long and approximately 55 cm wide, wherein the shape is determined by an arc of the curved elements (6*a*, 6*b*) and of upper side wall frame portions.

6. A container according to claim 1, wherein the fold axes are formed by a stiff connection that acts as a hinge between the frame elements (4) of the base (1) and the side walls (2*a*, 2*b*).

7. A container according to claim 1, wherein the curved elements (6*a*, 6*b*) are a component of an upper frame ring with which the frame elements (4) of the side walls (2*a*, 2*b*) are fixedly connected or connected to be movable relative to one another in a hinge-like manner.

8. A container according to claim 1, wherein the flexible material is a textile material.

9. A container according to claim 1, wherein the curved elements (6*a*, 6*b*) are fastened to the upper frame elements of the side walls.

10. A container according to claim 1, wherein either the curved part or the side parts have continuous frame elements at the fold edges and the other frame parts are foldably or pivotably fastened thereat.

11. A container according to claim 1, further comprising fasteners on the base for fixing the container to a support surface.

12. A container according to claim 11, wherein the fasteners are flat elements mounted at the base to extend transversely, or are stitched-on or fastened eyes (19), through which a securing belt can be passed or to which a securing belt can be fastened, which can be placed or tightened around the support or fastened to the support.

13. A container according to claim 1, wherein the container is a lying-down container for small children and dolls.

14. A container according to claim 11, wherein the fastening devices are connectable with complementary fastening devices at a baby-changing table, a mattress, a bed frame or a table top.

15. A container according to claim 1, wherein the container is a travel cot for small children.

16. A container according to claim 8, wherein the flat material is an unpadded or a padded textile material.

17. A container according to claim 1, wherein in the collapsed state, the container can be inserted or placed in a bag or a receptacle.

* * * * *